United States Patent [19]

Fredrick et al.

[11] Patent Number: 4,928,927

[45] Date of Patent: May 29, 1990

[54] LIFTING MECHANISM FOR HEAVY STREET GRATINGS

[76] Inventors: William R. Fredrick, 909 Lagoon La.; Robert H. Stuhler, 1024 Barnegat La., both of Mantoloking, N.J. 08738

[21] Appl. No.: 135,599

[22] Filed: Dec. 21, 1987

[51] Int. Cl.[5] ..... B66D 1/26; B66C 23/00

[52] U.S. Cl. ..... 254/279; 254/280; 254/296; 254/290; 254/324; 254/325; 414/684.3

[58] Field of Search ..... 254/323, 324, 325, 326, 254/327, 334, 279, 280, 296, 329, 4 R, 131; 280/43.24; 414/461, 684.3; 212/166

[56] References Cited

U.S. PATENT DOCUMENTS

| | | | |
|---|---|---|---|
| D. 184,343 | 2/1959 | Durbin | 254/325 X |
| 536,282 | 3/1895 | Harper | 414/461 |
| 776,797 | 12/1904 | Plant | 254/323 |
| 1,101,217 | 6/1914 | Stamm | 254/279 |
| 2,964,327 | 12/1960 | Mohr | 280/43.24 |
| 3,973,754 | 8/1976 | Chadwick, Jr. | 254/323 |
| 4,050,587 | 9/1977 | Moen | 254/325 X |
| 4,365,925 | 12/1982 | Girtz | 414/684.3 |

FOREIGN PATENT DOCUMENTS

| | | | |
|---|---|---|---|
| 1314014 | 11/1962 | France | 280/43.24 |
| 1476809 | 3/1967 | France | 254/325 |

*Primary Examiner*—Katherine A. Matecki
*Attorney, Agent, or Firm*—Ezra Sutton

[57] ABSTRACT

A lifting mechanism is provided to unseat and lift manhole covers and gratings and to replace them after servicing, easily and safely. The mechanism includes a frame, winches, cables, and hooks to lift and lower the covers and gratings. The mechanism also includes spuds for fixing the frame in position to prevent it from rolling into the hole being worked on.

7 Claims, 2 Drawing Sheets

LIFTING MECHANISM FOR HEAVY STREET GRATINGS

BACKGROUND OF THE INVENTION

This invention relates to apparatus for lifting heavy metal members and, in particular, the heavy metal covers or gratings of manholes, catch basins and sewers in the streets, which typically weigh about five hundred pounds. At the present time, there is no apparatus specifically constructed for lifting (curb side) catch basin covers or street manhole covers to permit cleanout or other maintenance operations to be performed. Presently, when a municipal employee is required to lift such a heavy metal plate or grating, he does so reluctantly, since he must employ great physical force and typically employs only a crowbar. This is a difficult and unsafe operation which requires more than one man and has resulted in injury, such as when the plate being lifted falls on a worker's foot.

SUMMARY OF THE INVENTION

The present invention is directed to a specially-constructed lightweight apparatus comprising a frame supported on ball bearing swivel casters so that it is portable and can be easily rolled into position over the heavy cover plate to be raised. The frame carries one or more winches for operating cables carrying hooks to be attached to the cover to be lifted. The frame also carries a pair of opposed spuds so that either of them can be anchored in position to the ground and the frame pivoted about the spud to pivot the cover away from the hole after it has been lifted and to pivot the cover back over the catch basin after servicing has been completed, eliminating any chance of the lifting apparatus falling into the basin The frame supporting the suspended cover also can then be rolled away to another position, if desired.

DETAILED DESCRIPTION OF THE INVENTION

Figure 1:
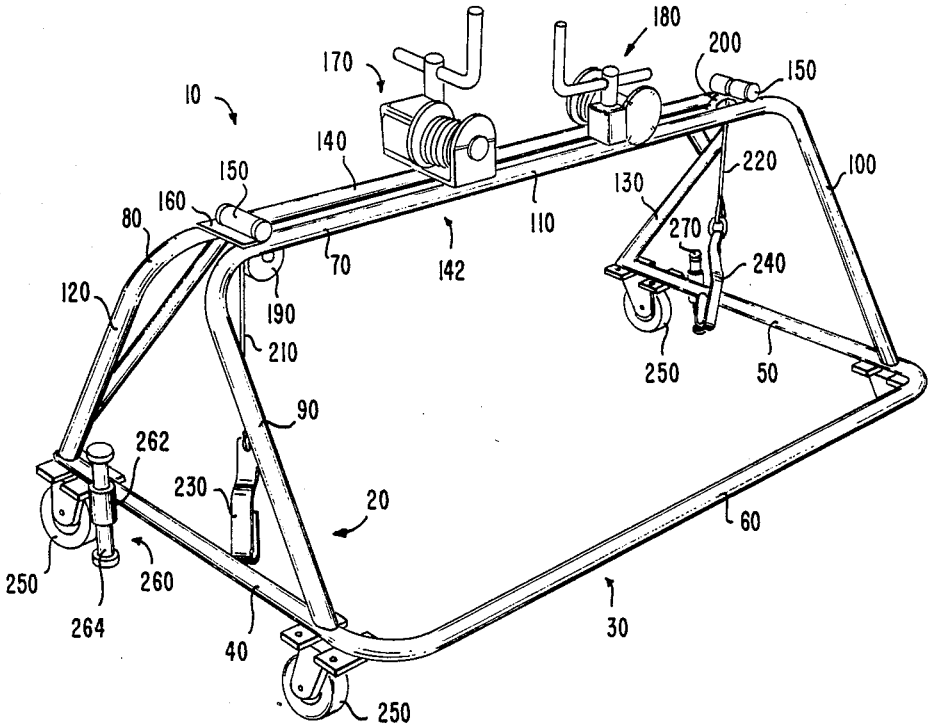
FIG. 1 is a perspective view of a lifting mechanism embodying the principles of the present invention.

The lifting apparatus of the invention 10 includes a frame 20 made up of a plurality of lengths of steel or alloy tubing including a horizontally-disposed bottom U-shaped frame 30 including left and right side tubes 40 and 50, respectively, and a connecting tube 60. The frame also includes second and third U-shaped tubular frame members 70 and 80 which are vertically disposed. The second frame member 70 includes left and right side tubes 90 and 100 and a connecting tube 110. The side tubes 90 and 100 have their free ends secured, as by welding, to the region where the bottom connecting tubular member 60 joins the side tube members 40 and 50. The third frame member 80 includes left and right side tubes 120 and 130 and a connecting tube 140. The side tubes have their free ends secured to the free ends of the side tubes of the horizontal frame members. The second and third frame members 70 and 80 are secured to the base frame member 30 at an angle so that they tilt toward each other with the connecting tubes 110 and 140 adjacent to but spaced from each other and coupled together by spaced-apart bolts 150 inserted in suitable threaded brackets 160 so that members 110 and 140 form an upper support frame 142.

A pair of high-capacity (1000 pounds line pull) worm gear winches 170 and 180 (e.g., Thern Model 462) are mounted on the adjacent connecting legs 110 and 140 of the second and third frame members 70 and 80. These winches will hold full load, unattended, at any time and must be hand rotated in reverse to lower the load, which is an important safety factor. Also, a pair of spaced-apart pulleys 190 and 200 are secured in the space between the connecting frame members 110 and 140 on upper support frame 142, and cables 210 and 220 extend from the winches 170 and 180, respectively, over the pulleys and carry hooks 230 and 240 at their respective ends. Alternatively, electromagnets may be used in place of hooks.

Casters 250 are suitably secured to the lower frame member 30 at the four corners thereof to allow ease of movement.

A first spud 260 made up of a threaded rod ($\frac{7}{8}$" diameter) 262 is vertically secured to the free end of the frame side member 40 and carries a threaded post 264 which is sufficiently long so that it can be threaded into engagement with the ground or street. A similar spud 270 having a threaded cylinder 272 and threaded rod 274 is secured to the free end of the other side 50 of the lower frame member.

In operation, the lifting apparatus 10 is rolled into position over a grating 280 to be raised, and the hooks 230 and 240 (or electromagnets) are coupled to opposite ends of the grating. Either spud post 264 or 274 is screwed into secure engagement with the street or ground to hold the frame 20 in place adjacent the hole in the street. One winch 170 or 180 is operated to free and lift one end of the grating covering the hole, and then the other winch is operated to lift the other end of the grating. The grating is then suspended in a level position, and the lifting mechanism 10 is pivoted away from the hole into a safe position by pivoting it about the spud which is secured to the ground. The spud can be released, and the frame and suspended grating rolled away from the hole to another location, if desired.

After the catch basin is cleaned out or treated, the lifting mechanism is pivoted back into place about the spud or is rolled back into place from a remote location, so that it surrounds the hole with the grating suspended above it. With the spud secured to prevent the lifting mechanism from rolling into the catch basin, the suspended grating is then lowered into place on the catch basin by operating the winches.

Figure 2:
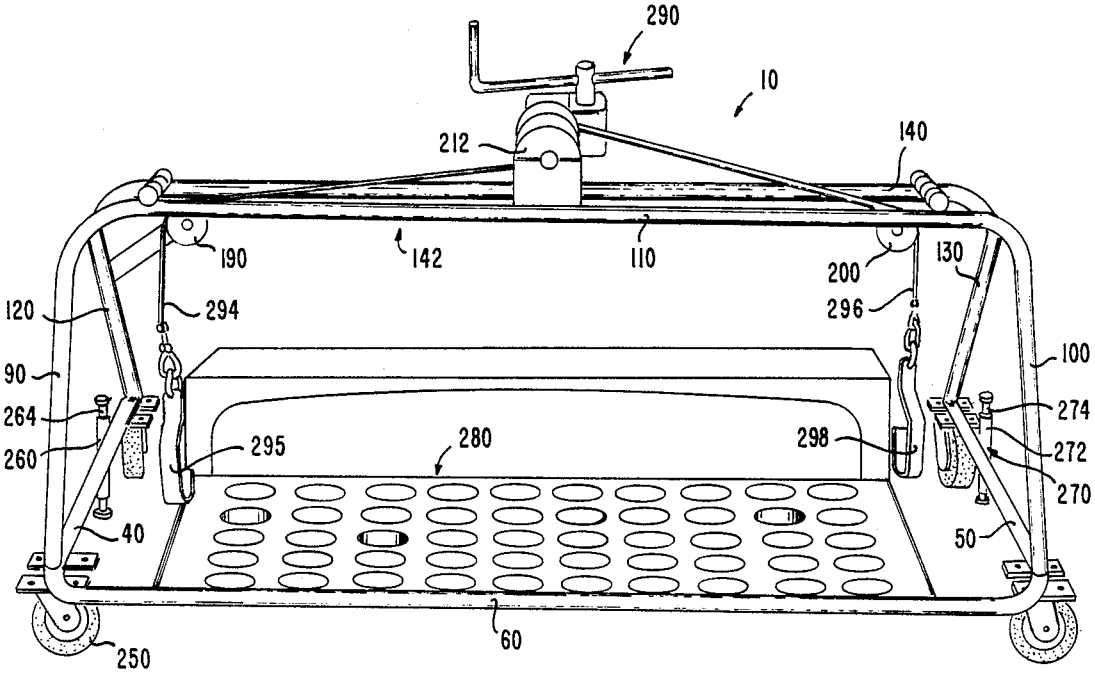
FIG. 2 is a perspective view of an alternative embodiment.

In a modification of the invention shown schematically in FIG. 2, power for performing the above-described lifting operation is performed with a single worm gear winch 290 of a type having a split drum 212. Such a winch is sold commercially by Thern. As illustrated, the winch 290 is mounted on the bars 110 and 140, as shown in FIG. 1, and a first cable or chain 294 is wound on one half of the split drum and carries a hook 295 at its end, and a second cable or chain 296 is wound on the other half of the split drum, and it carries a hook 298 at its end. As is well known, rotation of the winch 290 in one direction will cause the hooks 295 and 298 to lower, and rotation in the opposite direction, will cause the hooks to rise and raise the grating cover 280 to which they are attached, as described above.

Figure 3:
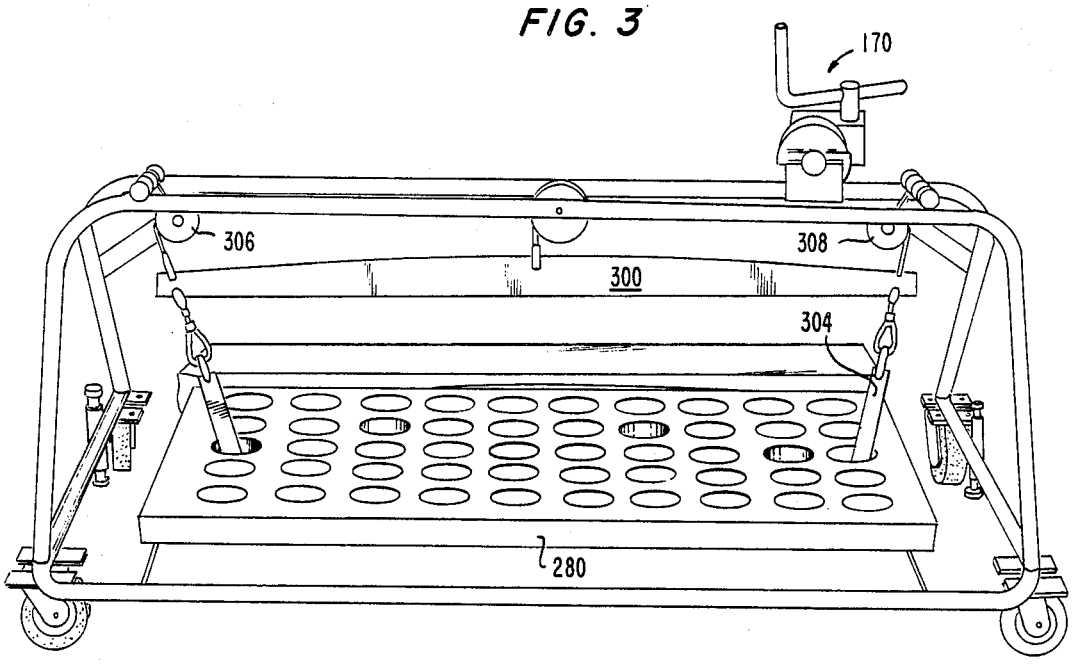
FIG. 3 is a perspective view of yet another embodiment.
Figure 4:
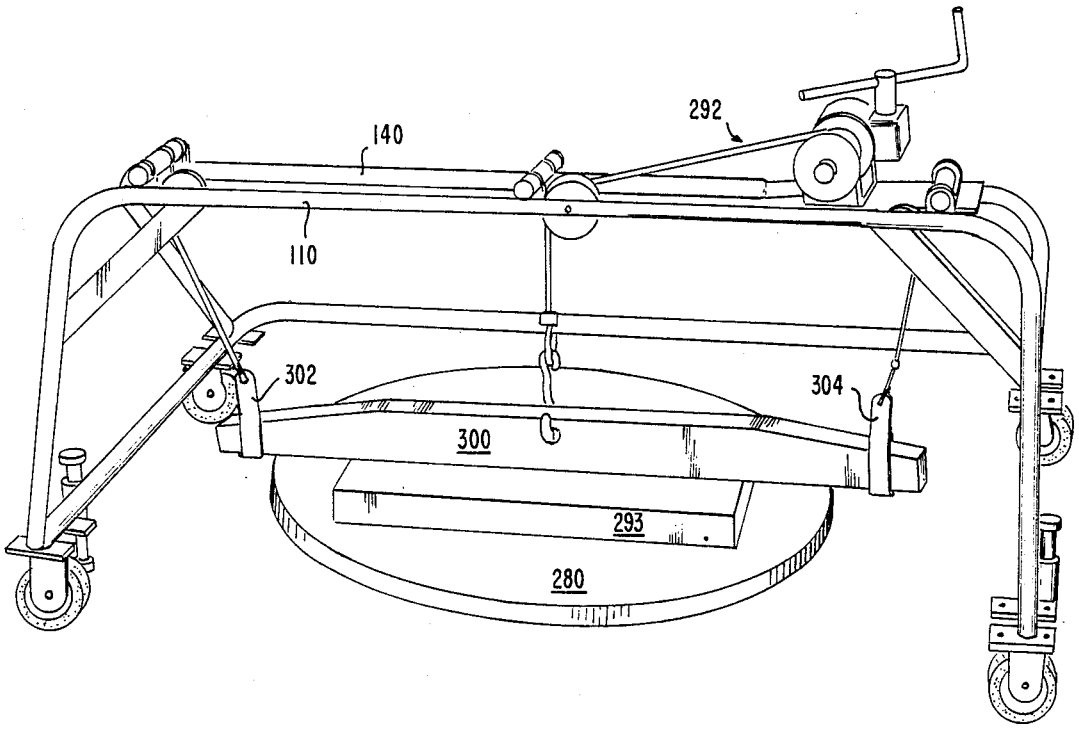
FIG. 4 is a view of a further modification.

In still another modification of the invention shown schematically in FIG. 3, a single drum worm gear winch, like winch 170, is employed in conjunction with a strong back arrangement for coupling to the grating to be raised. This arrangement includes a horizontal strong back beam 300 which carries hooks 302 and 304 at its ends. Two spring-loaded tag line reels 306 and 308 are mounted on the frame and are coupled by cables to the ends of the strong back beam to prevent horizontal movement thereof under load. In addition, a cable or chain is wound on the drum of the winch, and its free end is secured to the center of the strong back beam. It can be seen that a single winch can now be used to lift a catch basin cover 280 by having the hooks coupled thereto, generally as described above In another modification, the single drum worm gear winch 292 may be used with a strong back beam of the type shown in FIG. 3, and in still another modification of the invention, and in any modification which uses the strong back beam, an electromagnet 293 may be secured to the beam 300 and used to perform the lifting of the metal grating cover 280.

In another modification of the invention, a split flange is coupled to one winch, and two cables can thus be used separately or one at a time to lift a grating in the manner described above.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A lifting mechanism for heavy covers of catch basins, street manholes, and the like, comprising:

a rigid frame;

wheels on said frame for moving said frame about on a surface;

winch means including at least two drums mounted on said frame, each drum having an irreversible worm drive, said worm drives being independent of each other;

cable means coupled to and operated by said winch means;

coupling means connected to said cable means and adapted to be coupled to a heavy cover to be lifted and moved about; and surface-engaging means on said frame for securing a portion of said frame in place so that said frame can be pivoted on its wheel about said surface-engaging means as a pivot point.

2. The apparatus defined in claim 1 wherein said winch means includes two winches each having a drum, and said cable means includes two cables each operated by one of said winches, and said coupling means includes lifting means at the free end of each cable, said apparatus being operated by having said lifting means coupled to a heavy cover to be lifted, and then one drum being operated to unseat one portion of the cover from its seat, and then the second drum being operated to unseat the rest of the cover.

3. The apparatus defined in claim 1 wherein said surface-engaging means on said frame comprises a first spud at a first end of said frame and a second spud at a second end of said frame, each spud including a vertical tube secured to said frame, and a rod movably disposed in each vertical tube and of a length suitable to engage the ground when in use.

4. The apparatus defined in claim 1 wherein said frame includes a first generally U-shaped lower frame member including a left side tube and a right side tube and a connecting tube therebetween;

a second U-shaped frame member and a third U-shaped frame member each secured to said lower U-shaped frame member and extending upwardly therefrom and tilted toward each other so that portions of each cooperate to define an upper support member.

5. The apparatus defined in claim 4 wherein said winch means is supported on said upper support member.

6. The apparatus defined in claim 1 wherein said frame includes a first horizontally disposed lower U-shaped member having a left side tube, a right side tube, and a connecting tube therebetween;

a second U-shaped frame member including a left side tube, a right side tube, and a connecting tube therebetween, said second frame member being secured between said left side tube and said right side tube of said lower U-shaped member and extending upwardly therefrom;

a third U-shaped frame member including a left side tube, a right side tube, and a connecting tube therebetween, said third frame member being secured between said left side tube and said right side tube of said lower U-shaped member and extending upwardly therefrom; and said second and third U-shaped members being tilted toward each other so that their connecting tubes are positioned closely adjacent to each other with means securing them together to define an upper support member.

7. The apparatus defined in claim 6 wherein said winch means is supported on said upper support member.

* * * * *